United States Patent [19]

Kaneko et al.

[11] 4,189,138

[45] Feb. 19, 1980

[54] PAPER FEEDER

[75] Inventors: Kiyoshi Kaneko; Shigeru Ikeda; Ken-ichi Suzuki, all of Tokyo, Japan

[73] Assignee: Rank Xerox Ltd., London, England

[21] Appl. No.: 873,810

[22] Filed: Jan. 31, 1978

[30] Foreign Application Priority Data

Feb. 7, 1977 [JP] Japan ..... 52/12487[U]

[51] Int. Cl.[2] ..... B65H 3/06; B65H 3/60

[52] U.S. Cl. ..... 271/109; 271/21; 271/37

[58] Field of Search ..... 271/109, 37, 38, 117, 271/120, 21, 22, 23, 24, 25, 18, 19, 20, 248-252, 225, 172, 170, 121, 118, 34, 10, 119

[56] References Cited

U.S. PATENT DOCUMENTS

| | | | |
|---|---|---|---|
| 3,301,550 | 1/1967 | Reinecke | 271/272 |
| 3,601,389 | 8/1971 | Kramer | 271/170 X |
| 3,614,095 | 10/1971 | Beck et al. | 271/172 |
| 3,908,980 | 9/1975 | Fowler | 271/250 |

*Primary Examiner*—Bruce H. Stoner, Jr.
*Attorney, Agent, or Firm*—William A. Henry, II

[57] ABSTRACT

A paper feeding apparatus adapted to feed paper sheets one by one by the rotational force of feed rollers acting on the uppermost surface of stacked paper sheets, including a linkage arrangement for moving the feed rollers transverse to the direction of paper sheet feed.

1 Claim, 7 Drawing Figures

PAPER FEEDER

BACKGROUND OF THE INVENTION

This invention concerns a paper feeding apparatus in reproducing machines or likes for feeding paper sheets one by one from the uppermost surface of a bundle of stacked paper sheets.

Conventional paper feeding apparatus for feeding paper sheets one by one from the uppermost surface of a bundle of stacked paper sheets are adapted to feed sheets by the rotational force of feed rollers in contact with the uppermost surface of a bundle of stacked paper sheets.

Such a structure has, however, a disadvantage of frequently resulting in a sheet multi-feed in which two or more paper sheets, that is, not only the uppermost paper sheet but also the succeeding paper sheet (or sheets) feed simultaneously.

In view of the foregoing, means for preventing the above multi-feed have been devised including, for example, sheet feeders wherein the frictional force at the contact portion between the feed rollers and the uppermost paper sheet are changed by varying the materials of the feed rollers, contact loads exerted by the feed rollers and the like.

It is, however, difficult to positively prevent the multi-feed by the means above described.

The above difficulty is attributable to the fact that the multi-feed is mainly caused by the frictional engagement between paper sheets and the absence of air therebetween, and mere increase in the frictional force between the uppermost paper sheet and the feed rollers as described above have no substantial effects for the separation at all unless the vacuum between the uppermost paper sheet and the succeeding paper sheet is broken to reduce the attraction force therebetween.

This invention has been made in view of the foregoing and the object of the invention is to provide a paper sheet feeding apparatus comprising means for moving feed rollers transverse to the paper feed direction so that the uppermost paper sheet can be displaced relative to the next paper sheet in a direction crosswise to the paper feeding direction to form a gap between the uppermost paper sheet and the next paper sheet thereby releasing the vacuum attraction therebetween for improved feeding reliability.

BRIEF DESCRIPTION OF THE DRAWING

The drawings show preferred embodiments of this invention, wherein.

DESCRIPTION OF THE PREFERRED EMBODIMENT

Figure 1:
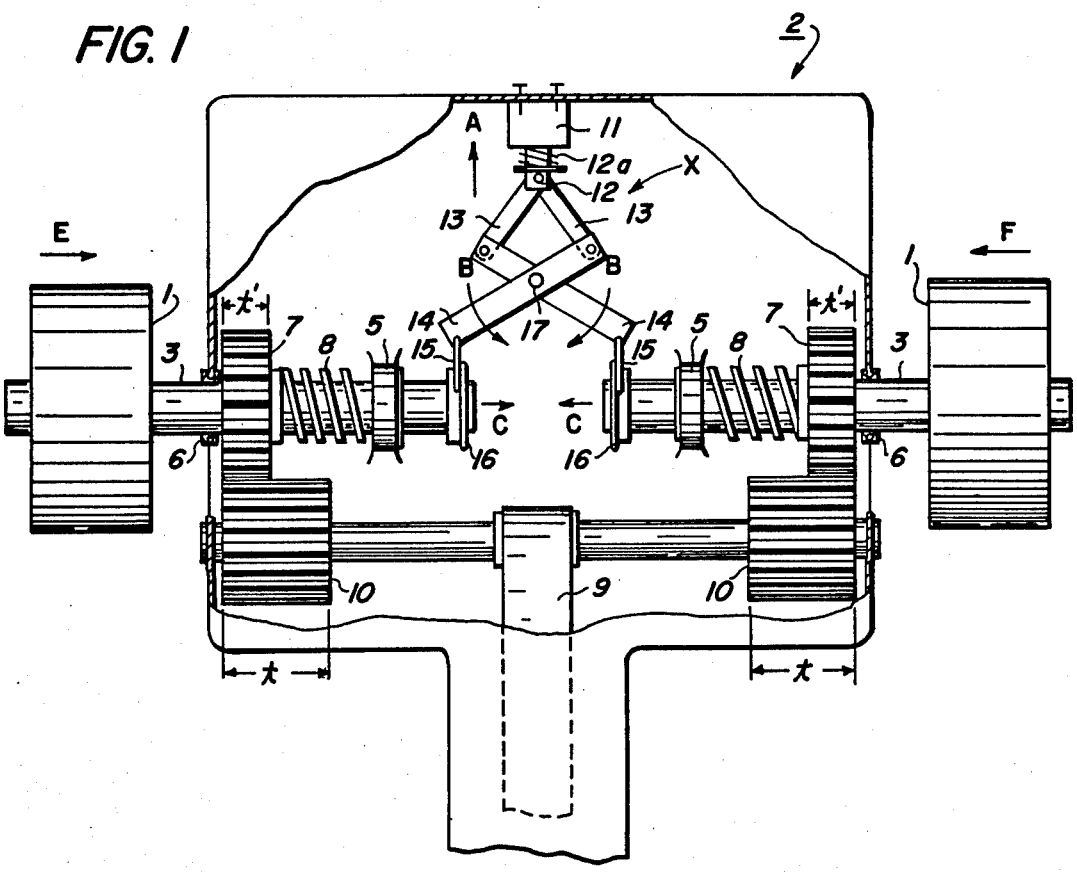
FIG. 1 is a plan view partially in section.

This invention will now be described hereinafter by way of its preferred embodiments referring to the drawings.

Figure 2:
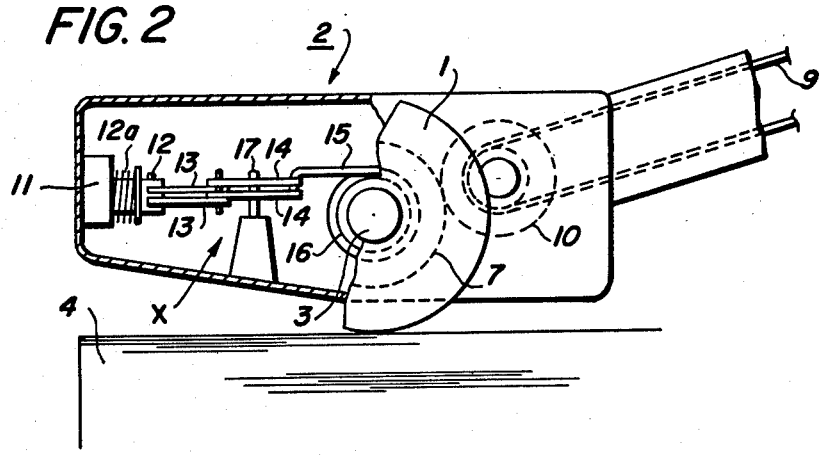
FIG. 2 is an elevational view partially in section.

A pair of feed rollers 1, 1 is mounted respectively on a pair of rotational shafts 3, 3 projecting from both sides of a driving box 2 which is rotatably supported for up and down movement to the frame of a paper feeding section in a reproducing machine (not shown). The pair of feed rollers 1, 1 is positioned in contact with the upper surface of paper sheets 4 as shown in FIG. 2.

Each of the rotational shafts 3 is rotationally supported on a pair of axle bearings 5, 6 provided respectively to the driving box 2. Further, each of the rotational shafts 3 is provided with gears 7 and biased away from each other by a compression spring 8 mounted between each of the gears 7 and each of the axle bearings 5.

Each of the above gears 7 meshes with gears 10 respectively which are rotationally driven by a belt 9 from a driving motor (not shown) in which the width t for each gear 10 is made greater than the width t′ of each gear 7 so that each gear 7 can be slidable in a transverse direction (crosswise to the paper sheet feeding direction).

Reference numeral 11 represents a solenoid secured to the driving box 2. A rod 12 connects the solenoid 11 with a link mechanism X which is in turn connected to the inner ends of the pair of the rotational axes 3, 3.

The link mechanism X comprises a pair of links 13 pivoted to the rod 12 and a pair of links 14, 14 pivoted to the pair of links 13, 13, in which the pair of links 14, 14 cross each other and are pivotally mounted at their crossing point to the driving box 2 by a pin 17 and fixed at their tops with levers 15, 15 respectively which engage flanges 16 secured to the inner end of each of the rotational axes 3.

Considering the operation of the disclosed mechanism, when the solenoid 11 is energized, its rod 12 is moved to retract in the direction of an arrow A shown in FIG. 1 against the resiliency of a spring 12*a*. The pair of links 14, 14 are therefore rotated by way of the pair of links 13, 13 respectively around the pin 17 as a center in the direction of an arrow B, which causes each of the rotational shafts 3 to move in the direction of an arrow C (direction closing to each other) through the engagement between each of the levers 15 and each of the flanges 16 respectively against the resiliency of the springs 8. Each of the feed rollers 1 is thus closed to each other by about 2–3 mm (in the direction of arrows E, F).

Figure 3:
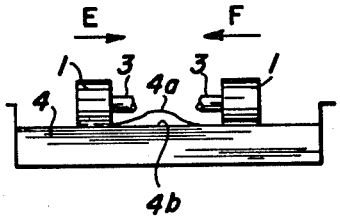
FIG. 3 is a view illustrating the roller position at the beginning of the feed cycle.

The uppermost paper 4*a* is therefore displaced relative to the next paper 4*b* crosswise to the paper sending direction to form an upward buckle in the middle portion thereof as shown in FIG. 3 thereby releasing the close vacuum attraction to the next paper sheet 4*b* to reduce the attraction force.

Accordingly, only the uppermost paper 4*a* will be fed by the feed rollers 1 thereby preventing multi-fed sheets.

When the solenoid 11 is de-energized, the rod 12 returns to the initial position by way of spring 12*a* to thereby return the link mechanism X to the initial state. Each of the rotational shafts 3 is also returned to the initial position by the force of each spring 8.

The solenoid 11 is designed to be energized just before the feed rollers 1 are driven to rotate, and de-energized when the rollers feed the uppermost paper 4*a* to some extent (about 5 cm).

Figure 4:
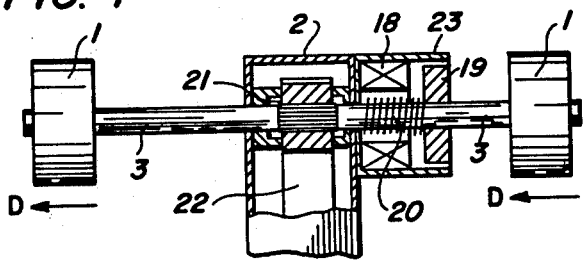
FIG. 4 is a transverse sectional view of a second embodiment.

The present invention is not restricted to the structure above described and may be constituted, for example, as shown in FIG. 4.

In the alternative, the rotational shaft 3 is made as an integral body and slidably mounted to the driving box 2 with the feed rollers 1 being mounted to both of the shaft ends. An electromagnet 18 is provided by way of a cylinder 23 on one side of the driving box 2 opposite an iron block 19 fixed to the rotational shaft 3. A spring 20 between the side of the driving box 2 and the iron block 19 resiliently biases the rotational shaft 3 to the right. Reference numeral 21 denotes a belt wheel in splined engagement with the rotational shaft 3, slidable in an axial direction and operationally connected to a driving source (not shown) by way of belt 22.

Figure 5A:
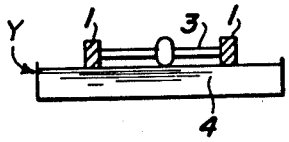
FIGS. 5*a* 5*b*, and 5*c* are explanatory views for the operation therefor.
Figure 5B:
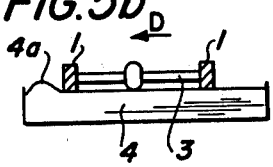

With the foregoing structure, when the electromagnet 18 is energized to attract the iron block 19 against the force of the spring 20, the rotational shaft 3 is caused to slide toward side registration means y from the state shown in FIG. 5*a* to the state shown in FIG. 5*b* as indicated by arrow D which forms a buckle in the uppermost paper 4*a*.

Figure 5C:
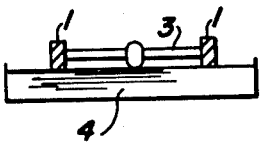

When the electromagnet 18 is de-energized, the feed rolls return to the initial position as shown in FIG. 5*c*.

In this embodiment, the uppermost sheet 4*a* can be displaced transverse to the sheet feed direction to thereby form a gap between it and the succeeding sheet 4*b*.

Accordingly, the vacuum attraction between the uppermost paper sheet 4*a* and the succeeding paper sheet 4*b* can be released to thereby reduce the attraction force therebetween to prevent multi-fed sheets.

While I have described the preferred embodiment of this invention it should be understood that the invention is not limited thereto but may be otherwise embodied within the scope of the following claims.

What is claimed is:

1. A sheet feeding apparatus including two feed rolls in axial alignment and adapted for rotation about an axis for feeding sheets from a sheet supply tray perpendicular to the feed rolls axis, the improvement comprising side registration means adjacent to the supply tray, and means for moving the feed rolls axially at the start of each feed cycle, said moving means being adapted to simultaneously shift said two feed rolls axially toward said side registration means to form a buckle in the top sheet in the tray between said side registration means and the feed roll adjacent thereto to reduce the attraction force between the sheet being fed and the adjacent sheet.

* * * * *